US007124588B2

(12) United States Patent
Gerendas et al.

(10) Patent No.: US 7,124,588 B2
(45) Date of Patent: Oct. 24, 2006

(54) COMBUSTION CHAMBER OF GAS TURBINE WITH STARTER FILM COOLING

(75) Inventors: Miklos Gerendas, Zossen (DE); Michael Ebel, Rangsdorf (DE)

(73) Assignee: Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 54 days.

(21) Appl. No.: 10/403,055

(22) Filed: Apr. 1, 2003

(65) Prior Publication Data

US 2003/0182943 A1 Oct. 2, 2003

(30) Foreign Application Priority Data

Apr. 2, 2002 (DE) ..... 102 14 573

(51) Int. Cl.
*F02C 1/00* (2006.01)
*F02G 3/00* (2006.01)

(52) U.S. Cl. ..... 60/752; 60/754

(58) Field of Classification Search ..... 60/752, 60/754, 755, 756, 757
See application file for complete search history.

(56) References Cited

U.S. PATENT DOCUMENTS 2,742,762 A * 4/1956 Kuhring ..... 60/752
4,686,823 A * 8/1987 Coburn et al. ..... 60/800
4,864,827 A * 9/1989 Richardson et al. ..... 60/756
4,916,095 A * 4/1990 Fogler et al. ..... 502/62
4,934,145 A * 6/1990 Zeisser ..... 60/756
5,000,005 A * 3/1991 Kwan et al. ..... 60/757
5,012,645 A * 5/1991 Reynolds ..... 60/754
5,129,231 A * 7/1992 Becker et al. ..... 60/754
5,142,871 A * 9/1992 Lampes et al. ..... 60/756
5,161,223 A * 11/1992 Abraham ..... 707/3
5,241,827 A * 9/1993 Lampes ..... 60/754
5,253,471 A * 10/1993 Richardson ..... 60/804
5,261,223 A 11/1993 Foltz
5,279,127 A * 1/1994 Napoli ..... 60/754
5,307,637 A * 5/1994 Stickles et al. ..... 60/756
5,329,761 A * 7/1994 Ablett et al. ..... 60/804
5,331,805 A 7/1994 Myers et al.
5,490,389 A * 2/1996 Harrison et al. ..... 60/737
5,623,827 A * 4/1997 Monty ..... 60/748
5,664,412 A * 9/1997 Overton ..... 60/39.23
5,894,732 A * 4/1999 Kwan ..... 60/756
5,918,467 A 7/1999 Kwan
5,941,076 A * 8/1999 Sandelis ..... 60/752
5,956,955 A * 9/1999 Schmid ..... 60/748
6,035,645 A * 3/2000 Bensaadi et al. ..... 60/742
6,145,319 A * 11/2000 Burns et al. ..... 60/755
6,155,056 A * 12/2000 Sampath et al. ..... 60/756
6,205,789 B1 * 3/2001 Patterson et al. ..... 60/754
6,260,359 B1 * 7/2001 Monty et al. ..... 60/752

(Continued)

FOREIGN PATENT DOCUMENTS

DE 4131069 7/1992

(Continued)

OTHER PUBLICATIONS

German Search Report Feb. 28, 2003.

(Continued)

*Primary Examiner*—William H. Rodriguez
(74) *Attorney, Agent, or Firm*—Timothy J. Klima

(57) ABSTRACT

A combustion chamber of a gas turbine includes starter film cooling of a combustion chamber wall 4 and several circularly arranged burners 7 with local maxima and minima in the intensity of the starter film 3 being provided around the circumference of the combustion chamber wall 4.

27 Claims, 7 Drawing Sheets

U.S. PATENT DOCUMENTS

| | | | | |
|---|---|---|---|---|
| 6,266,961 | B1 * | 7/2001 | Howell et al. | 60/752 |
| 6,408,629 | B1 * | 6/2002 | Harris et al. | 60/804 |
| 6,434,821 | B1 * | 8/2002 | Nelson et al. | 29/888.01 |
| 6,474,070 | B1 * | 11/2002 | Danis et al. | 60/739 |
| 6,513,331 | B1 * | 2/2003 | Brown et al. | 60/754 |
| 6,546,731 | B1 * | 4/2003 | Alkabie et al. | 60/754 |
| 6,546,733 | B1 * | 4/2003 | North et al. | 60/772 |
| 6,655,146 | B1 * | 12/2003 | Kutter et al. | 60/752 |
| 6,655,149 | B1 * | 12/2003 | Farmer et al. | 60/754 |
| 6,735,950 | B1 | 5/2004 | Howell et al. | |
| 6,871,488 | B1 * | 3/2005 | Oskooei et al. | 60/39.465 |

FOREIGN PATENT DOCUMENTS

| | | |
|---|---|---|
| EP | 0471438 | 2/1992 |
| EP | 0521687 | 1/1993 |
| EP | 1084372 | 12/1999 |
| EP | 1001222 | 5/2000 |
| EP | 1092925 | 4/2001 |

OTHER PUBLICATIONS

European Search Report dated Dec. 3, 2004.

* cited by examiner

Fig. 7
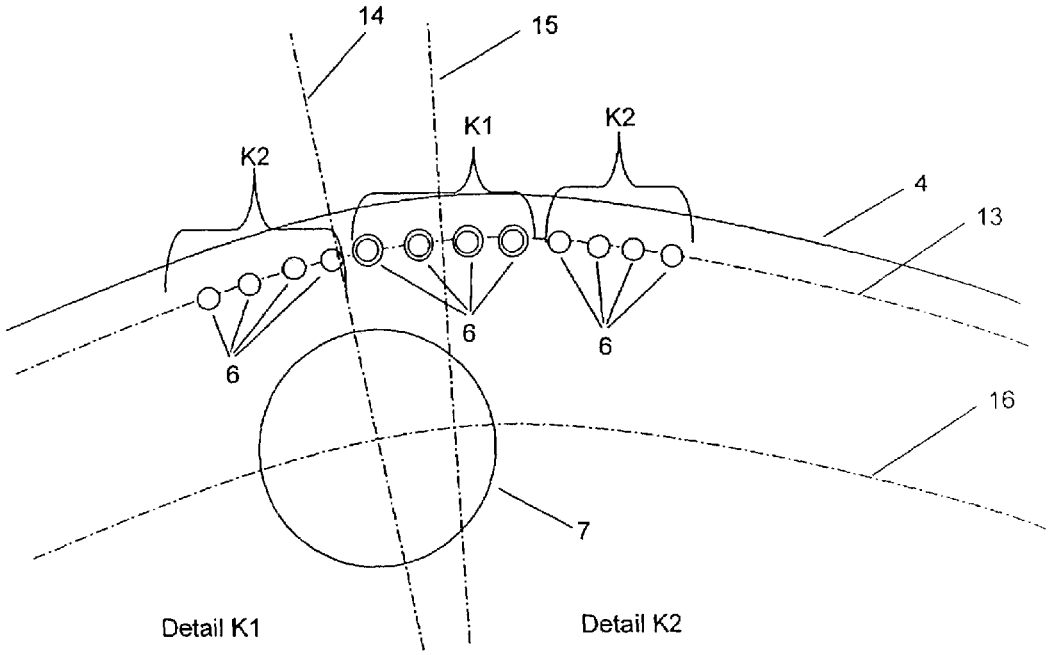
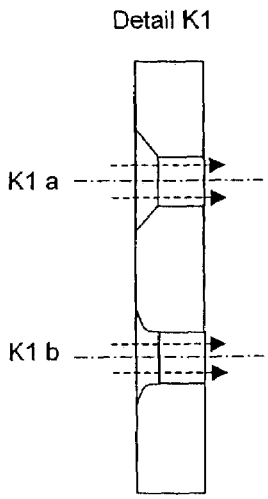
Fig. 8a
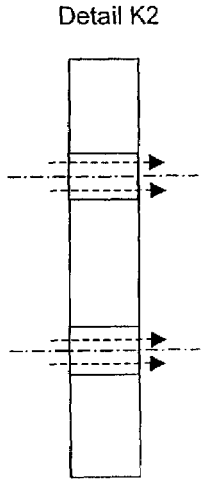
Fig. 8b

COMBUSTION CHAMBER OF GAS TURBINE WITH STARTER FILM COOLING

This application claims priority to German Patent Application DE10214573.3 filed Apr. 2, 2002, the entirety of which is incorporated by reference herein.

BACKGROUND OF THE INVENTION

This invention relates to a combustion chamber of a gas turbine with starter film cooling of a combustion chamber wall and with several, circularly arranged burners.

The combustion chamber wall encloses a space in which fuel is burnt with the compressed air supplied by the compressor before it is expanded in the turbine to deliver power. The combustion chamber wall must be suitably cooled since the gas temperatures in the combustion chamber generally exceed the melting temperature of the wall material. To ensure longevity, the temperature values must be kept appropriately low. The combustion chamber wall can be equipped with cooling rings (U.S. Pat. No. 4,566,280), effusion holes (U.S. Pat. No. 5,181,379), pinned tiles (EP 1 098 141 A1) or impingement and effusion-cooled tiles (U.S. Pat. No. 5,435,139).

Independently of the cooling method selected, the combustion chamber wall must be protected upstream of the first cooling air inlet, since cooling of the rear side alone is inadequate to keep the temperature level below the applicable limit. Therefore, a so-called starter film is usually applied to the forward part of the combustion chamber wall. This starter film protects the combustion chamber wall until the cooling method actually used has sufficient effect. The air required for this starter film can be supplied from within the space formed by a hood and a base plate or from an annulus between the combustion chamber wall and the combustion chamber casing. The openings in the combustion chamber wall are mostly circular, evenly distributed holes of constant cross-section whose inlet side is neither chamfered nor rounded. The starter film is mainly introduced parallel to and along the combustion chamber wall.

Such a starter film for an effusion-cooled combustion chamber wall is provided in Specification U.S. Pat. No. 5,279,127. However, this Patent Specification only refers to a single-wall design. The gap from which the circumferentially evenly distributed cooling (starter) film discharges is formed by a cooling ring.

In another design known from the state of the art, the air for the starter film is conducted only on one side by way of an element belonging to the combustion chamber wall, while, on the other side, it is confined by a flow surface of the heat shield. The starter film is blown out between the heat shield and the initial portion of the combustion chamber wall to protect this part of the combustion chamber against the hot combustion gases. This is usually accomplished by an evenly distributed number of circular holes arranged on a specific pitch circle on the inlet side, these holes being neither chamfered nor rounded. For uniformity, the individual jets can initially be blown onto the rear of the heat shield. Upon impingement, the jets will cool the heat shield and combine into a homogenous film (starter film) which then flows along the combustion chamber wall. In particular, if effusion cooling is applied for the combustion chamber wall—which can be single-walled or provided with additionally impingement-cooled tiles—a protective cooling film will initially be produced down the stream over a certain distance. Without such a starter film, the initial portion of the combustion chamber wall would not be protected sufficiently.

A disadvantage of the known designs lies in the fact that the starter film is evenly distributed around the entire circumference of the combustion chamber wall. This results in a uniform distribution of the cooling intensity of the starter film. However, since the heat input into the combustion chamber wall increases periodically with each burner and decreases in the spaces between them, a temperature variation will invariably occur in the circumferential direction in the combustion chamber wall. A temperature limit applies to the material which, also at the point of maximum thermal load of the combustion chamber wall, shall not be exceeded. Accordingly, the air quantity of the starter film is controlled by that point on the circumference of the combustion chamber wall which is subject to the highest thermal load, this point being usually situated in the vicinity of the burner axis. However, the quantity of cooling air thus supplied with the starter film to the combustion chamber wall will be excessive in the area between the burners. Consequently, the combustion chamber wall will be overcooled to an unnecessary extent in this area. This non-adaptive cooling method results in pronounced circumferential temperature variations in the combustion chamber wall. These variations, in turn, subject the combustion chamber wall to severe mechanical stresses. These stresses significantly compromise the life of the combustion chamber wall, particularly if effusion cooling is applied.

BRIEF SUMMARY OF THE INVENTION

In a broad aspect, the present invention provides a combustion chamber of the type specified above which, while being simply designed and easily and cost-effectively producible, is cooled in an optimized manner to ensure its longevity.

It is a particular object of the present invention to provide solution to the above problem by the features described herein, with further objects and advantages of the present invention becoming apparent from the description below.

The present invention, accordingly, provides for the formation of local maxima and minima in the intensity of the starter film around the circumference of the combustion chamber wall.

The combustion chamber according to the present invention is characterized by a variety of merits. In accordance with the present invention, the temperature gradient of the combustion chamber wall decreases in the circumferential direction. Thus, the thermally induced stresses in the combustion chamber wall will decrease drastically, so that, for a specific material, the life of the combustion chamber wall can be increased significantly at a given temperature.

However, in accordance with the present invention, it is also possible to increase, for a given material, the operating temperature of the combustion chamber (combustion chamber wall), with life remaining equal.

The present invention is further advantageous in that a weaker and/or less costly material can be substituted for the material previously used, with the temperature and the life of the combustion chamber wall remaining equal.

Thus, in accordance with the present invention, the starter film is varied in the circumferential direction of the combustion chamber in such a manner that a uniform temperature is obtained in the combustion chamber wall.

Accordingly, a number of maxima and minima is obtained by variation of the intensity of the starter film which can be equal to the number of burners or can be an integer multiple of the number of burners.

In accordance with the present invention, a starter film with varying intensity can be produced in the most different ways. The openings for the conduction of cooling air and the formation of the starter film, in accordance with the present invention, need not necessarily be circular holes. Since these openings are mostly cut by laser, they can have any shape. Also, the cross-section of the respective opening need not be constant at any point along its axis. In accordance with the present invention, it is crucial that a pre-defined quantity of air flows through this opening. Accordingly, an opening with a specific area and a specific coefficient of flow is to be provided. In the case of irregularly shaped openings, the equivalent or hydraulic diameter is used as reference for the specification of the quantity of air to be passed and where used herein, such terms are intended to encompass the actual diameters of holes having circular cross-section. For simplification and clarification of the following discussion, reference is hereinafter made to openings or holes, although these need not necessarily be of circular cross-section.

In accordance with the present invention, the variation of the quantity of air for the formation of the starter film can be accomplished in different ways.

The flow quantity per circumferential length of the combustion chamber can, as one option, be varied by altering the equivalent diameter of the evenly distributed starter film holes.

In an alternative embodiment of the present invention, the spacing of the starter film openings or holes is varied, with the equivalent opening or hole diameter remaining equal.

Also, the starter film holes can be arranged on a varying number of pitch circles.

In a further embodiment of the present invention, it can be favorable to vary the flow coefficient of the openings, with the geometry of the exit being fixed and the cross-section of the openings being constant, for example by differently rounding or chamfering the upstream edge of the opening.

Variation of the quantity of air of the starter film can be continuous or be reduced to discrete states, for example two or three. This is hereinafter explained more fully by way of an embodiment.

In accordance with the present invention, the methods for the variation of the quantity of air for the formation of the starter film, or the generation of the respective maxima or minima, can also be combined. Also, in accordance with the present invention, a starter film can fully be dispensed with between individual burners on a limited portion of the circumference of the combustion chamber wall. In a further development of the present invention, starter film cooling can be varied such that it is asymmetrical to the respective burner axis, i.e. to provide maximum cooling exactly on the symmetry axis of the burners and minimum cooling exactly between the symmetry axes. Since the maximum and minimum stress of the combustion chamber wall are shifted in the circumferential direction by the burner swirl, it can be advantageous if the variation of the starter film thickness is correspondingly shifted in this direction. Thus, the thickness of the starter film will always be limited to the locally necessary quantity. This results in a further saving of cooling air, which is then available for use in the mixture preparation process for the reduction of pollution emissions.

BRIEF DESCRIPTION OF THE DRAWINGS

This invention is more fully described in the light of the accompanying drawings showing preferred embodiments. In the drawings:

FIG. 7 is a still another embodiment of the starter film holes in accordance with the present invention, and FIGS. 8*a–b* are two detail views of FIG. 7.

DETAILED DESCRIPTION OF THE INVENTION

This detailed description should be read in conjunction with the summary above, which is incorporated by reference in this section.

Figure 1:
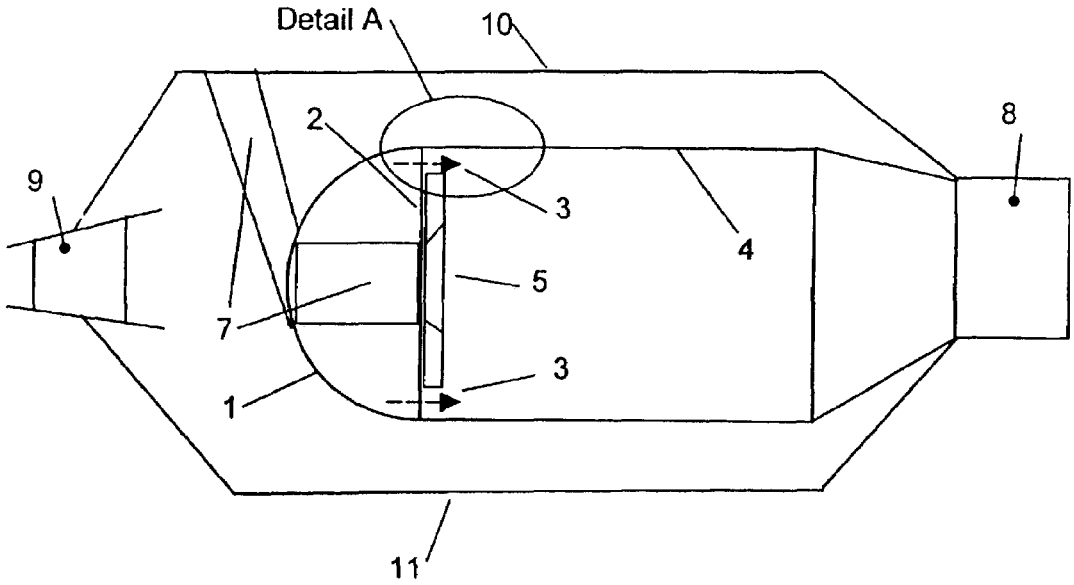
FIG. 1 is a cross-section of a gas turbine combustion chamber.

FIG. 1 shows, in schematic side view, a section through a gas turbine combustion chamber according to the present invention. It comprises a hood 1 of a combustion chamber head and a base plate 2. Reference numeral 4 indicates a combustion chamber wall with a downstream turbine nozzle guide vane 8 shown in schematic representation. Reference numeral 10 indicates a combustion chamber outer casing, while a combustion chamber inner casing is designated with the reference numeral 11. In the inlet area of the combustion chamber, a guide vane 9 in the compressor exit is shown. Reference numeral 7 shows a burner with burner leg and vortex generator. Furthermore, the gas turbine combustion chamber comprises a heat shield 5 with an opening for the burner 7 and individual openings 6 for the generation of the starter film, these openings being described further below.

Figure 2:
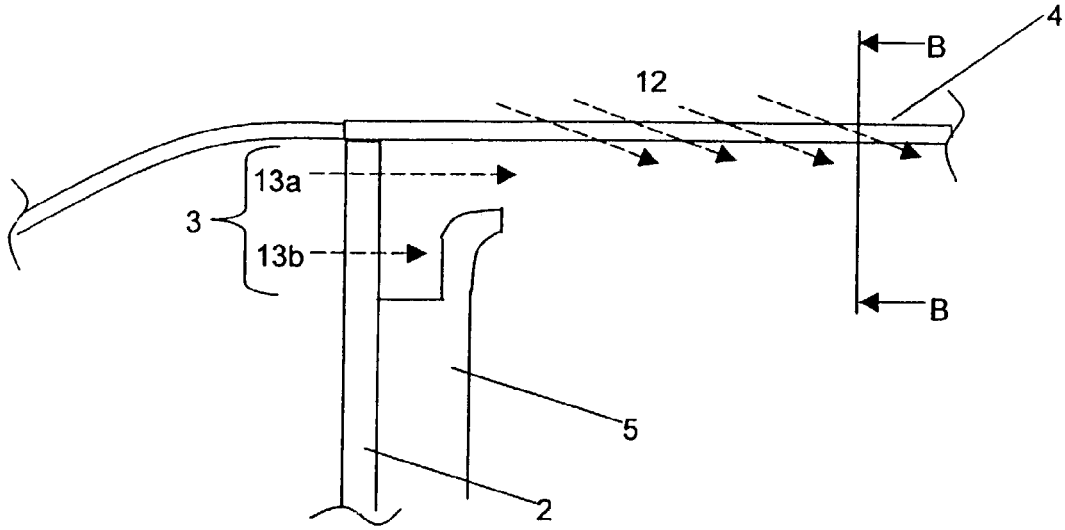
FIG. 2 is a detail of a combustion chamber head, with the cooling and the starter film being shown.
Figure 3:
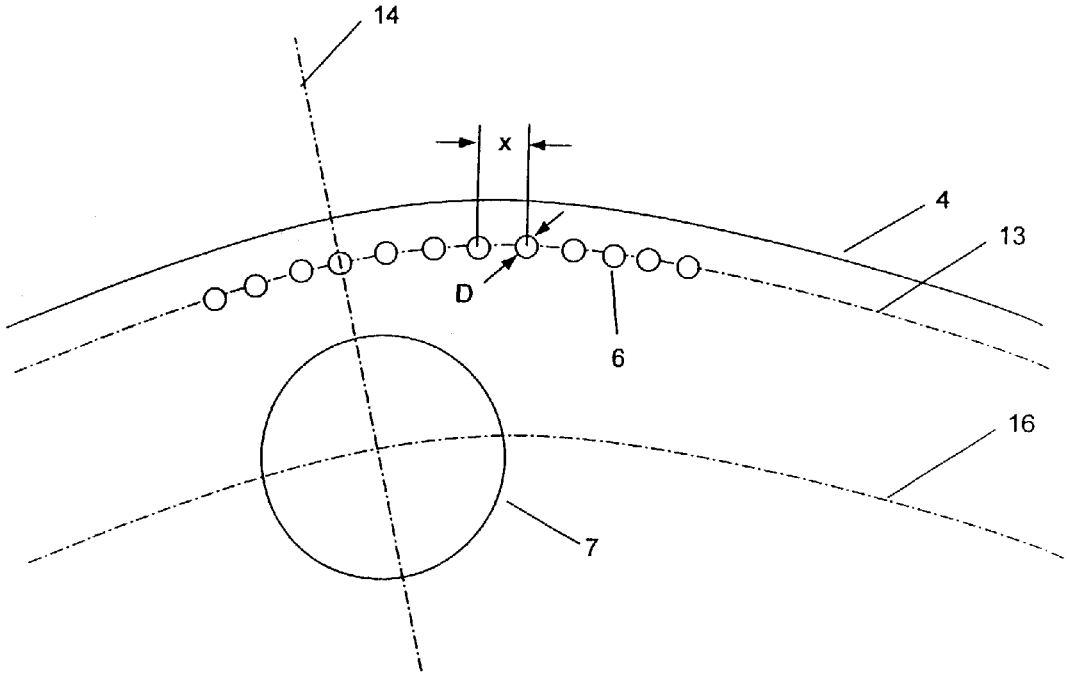
Fig. 3 (Prior Art)
FIG. 3 is the state-of-the-art arrangement of starter film holes in the direction of view B—B according to FIG. 2.

As becomes apparent from the detail A shown in FIG. 2, the air for the starter film 3 is supplied from within the space formed by the hood 1 and the base plate 2 or from the annulus between the combustion chamber wall and the combustion chamber casings 10, 11. In another design known from the state of the art, the air for the starter film 3 is conducted on only one side by way of a component belonging to the combustion chamber wall 4, while, on the other side, it is confined by a flow surface of the heat shield 5. The starter film 3 is discharged between the heat shield 5 and the forward portion of the combustion chamber wall 4 to protect this portion against the hot combustion gases (see FIG. 1). This is usually accomplished by way of an evenly distributed number of circular holes arranged on a specific pitch circle on the inlet side, these holes being neither chamfered nor rounded. The arrangement of the holes 6 according to the state of the art is shown in FIG. 3, with the reference numeral 14 indicating the burner axis (symmetry line of the burner) and with the reference numeral 13 designating the pitch circle of the starter film 3. The pitch circle of the burner 7 is indicated by the reference numeral 16. The individual holes 6 have a spacing x and a diameter D.

Accordingly, the openings are arranged on a specific pitch circle 13 on the inlet side, these holes being neither chamfered nor rounded. For uniformity, the individual air jets can initially be discharged on the rear side of the heat shield 5. Upon impingement, these jets cool the heat shield 5 and combine into a homogenous film which then flows along the combustion chamber wall 4 (see FIG. 2). The partial zones of the starter film and the individual pitch circles are identified by the reference numerals 13*a* and 13*b*, respectively.

Reference numeral 12 indicates the further cooling of the combustion chamber wall 4 by effusion. In this area, the combustion chamber wall 4 can be single-walled or be provided with additionally impingement-cooled combustion chamber tiles.

Figure 4:
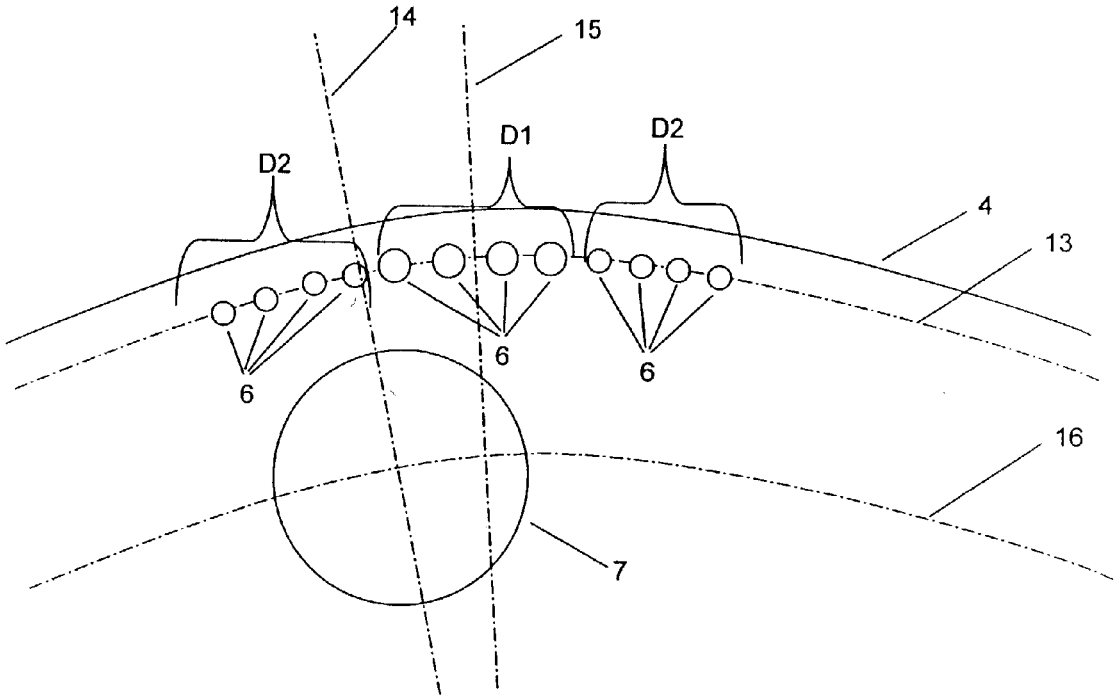
FIG. 4 is a first embodiment of the starter film holes in accordance with the present invention, analogically to FIG. 3.

FIG. 4 shows a first embodiment of the invention, in which, as also becomes apparent from the following Figures, a symmetry line 15 of the maximum starter film is circumferentially offset relative to the symmetry line of the burner 7 (burner axis 14).

The embodiments in FIGS. 4 to 7 not only show the pitch circles 13 of the starter film 3, but also the pitch circle 16 of the burner 7. Reference numeral 4 indicates the combustion chamber inner wall, with the FIGS. 4 to 7 each showing the direction of view B—B according to FIG. 2.

In the embodiment according to FIG. 4, the flow quantity per circumferential length is varied by a variation of the equivalent diameter D of the evenly distributed starter film holes 6. The corresponding diameters D1 and D2 refer to the respective groups of starter film holes 6, with the diameter D2 being smaller than the diameter D1. In this manner, there is more flow from the holes D1 to provide additional cooling in this respective circumferential portion of the combustion chamber.

Figure 5:
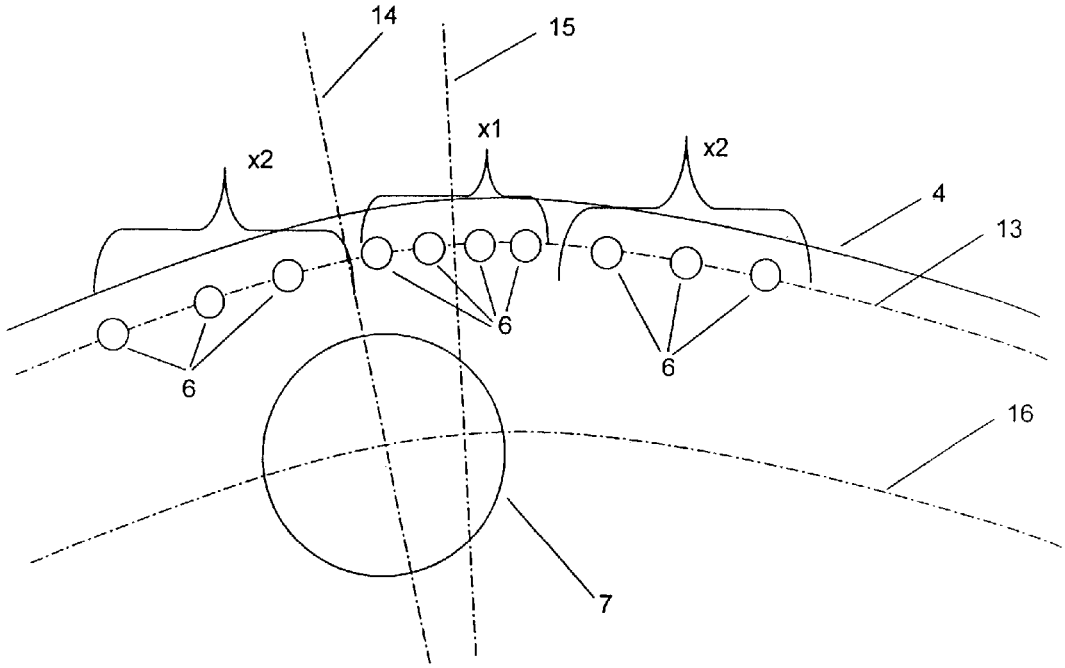
FIG. 5 is another embodiment of the starter film holes in accordance with the present invention, analogically to FIG. 4.

In the embodiment shown in FIG. 5, the spacing of the starter film holes 6 is varied, with the equivalent diameter being equal. The different groups of hole spacings are indicated with x1 or x2, respectively, with the spacing x1 being smaller than the spacing x2. In this manner, there is more flow from the holes x1 to provide additional cooling in this respective circumferential portion of the combustion chamber.

Figure 6:
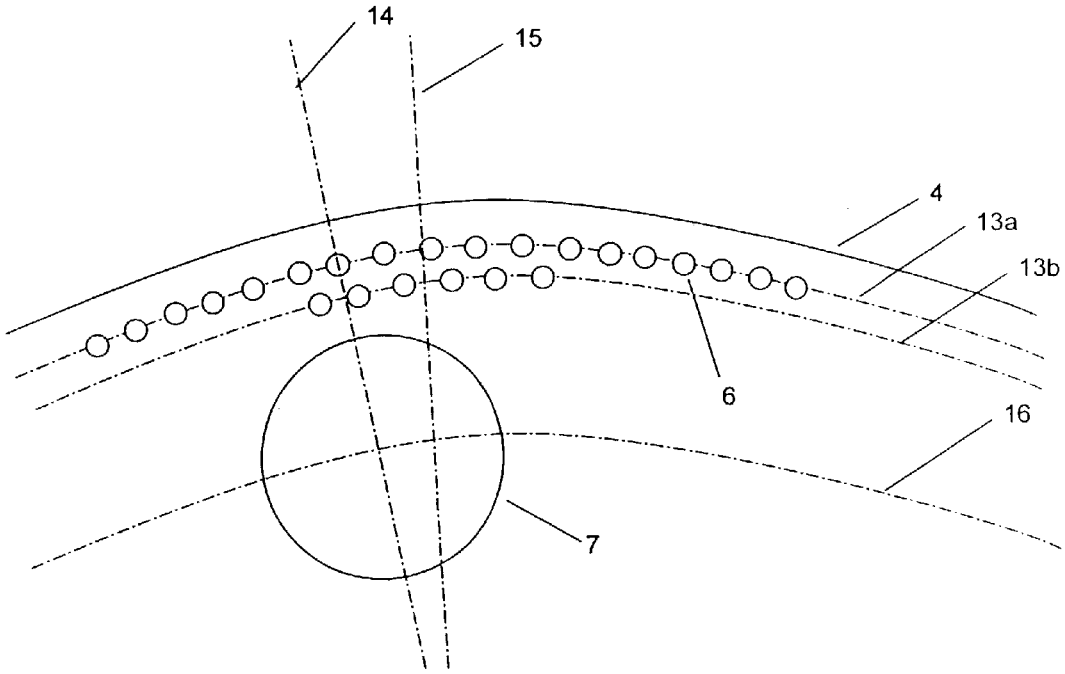
FIG. 6 is a further embodiment of the starter film holes.

FIG. 6 shows a further embodiment, in which the variation of the starter film 3 is accomplished by differently occupied pitch circles 13*a* and 13*b*. In this embodiment, additional holes 6 are positioned along one or more further pitch circles, such as pitch circle 13*b*, in circumferential portions of the combustion chamber where additional cooling is desired. The flow from the holes 6 along pitch circle 13*a* is set to provide the minimum required cooling in the other circumferential portions of the combustion chamber.

FIGS. 7 and 8 show a further embodiment, in which the variation of the starter film 3 is accomplished by the inlet contours K1 or K2, respectively, of the openings 6. In the case of contour K1 (detail K1), a chamfer or a rounding radius b is provided. As shown in detail K2, the opening can also be provided without chamfer or rounding radius. In this embodiment, the circumferentially varying diameter ranges, for example, from 0.5 to 5 mm, preferably from 1 to 2.5 mm. The circumferentially varying ratio of the center distance to the diameter of the holes 6 preferably lies in a range from 1.5 to 10 mm, preferably from 2 to 5 mm. The width of the chamfer ranges, for example, from 0–5 mm, preferably from 0.5 to 2 mm. The angle of the chamfer is, for example, 15 to 75 degrees, preferably 30 to 60 degrees, ideally nearly 45 degrees. The inlet radius favorably lies in a range of 0 to 5 mm, preferably 0.5 to 2 mm.

As becomes apparent from FIGS. 7 and 8, the variation can be continuous or can be reduced to discrete states, for example two or three. For example, diameters D of the starter film holes 6 of D1=2.5 mm and D2=1 mm (see FIG. 3) or standardized circumferential spacings can be provided (see FIG. 4, for example), with values of x1/D=2 and x2/D=4. Also, starter film holes 6 with equal diameter D and equal spacing x can be provided on two pitch circles 13*a* and 13*b* or on only one pitch circle 13*a* or 13*b* (see FIG. 6), as well as chamfers, for example 1 mm×45° or radii, for example R=0.5 mm (see FIG. 7).

The shift of the starter film thickness in the circumferential direction (symmetry line 15) can, for example, be 4 degrees, as shown in FIGS. 4 to 7.

It is intended that various aspects of the various embodiments can be combined in different manners to create different embodiments.

It is apparent that modifications other than described herein may be made to the embodiments of this invention without departing from the inventive concept.

What is claimed is:

1. A gas turbine combustion chamber including starter film cooling of a combustion chamber wall and several circularly arranged burners, wherein, the starter film cooling is provided by starter film holes positioned in a head of the combustion chamber upstream of any film cooling holes provided on a wall of the combustion chamber, the starter film holes being grouped into at least a first set of groups and a second set of groups, the first set of groups providing local starter film maxima with a greatest starter film air flow in certain sectors around a circumference of the combustion chamber where a thermal load is greater as compared to the second set of groups providing local starter film minima with a least starter film air flow in other sectors around the circumference of the combustion chamber where a thermal load is lesser to decrease a temperature gradient of the combustion chamber wall in a circumferential direction.

2. A gas turbine combustion chamber in accordance with claim 1, wherein, a number of at least one of the local starter film maxima and the local starter film minima, respectively, is equal to a number of the burners.

3. A gas turbine combustion chamber in accordance with claim 1, wherein, a number of at least one of the local starter film maxima and the local starter film minima, respectively, is an integer multiple of the burners.

4. A gas turbine combustion chamber in accordance with claim 1, wherein, the local starter film maxima and local starter film minima are produced by the air quantities passed through different groups of starter film holes, respectively.

5. A gas turbine combustion chamber in accordance with claim 4, wherein, at least certain of the starter film holes have different effective flow areas.

6. A gas turbine combustion chamber in accordance with claim 5, wherein, the starter film holes are equally distributed around the circumference of the combustion chamber.

7. A gas turbine combustion chamber in accordance with claim 5, wherein, at least certain of the starter film holes have a different hole spacing around the circumference of the combustion chamber.

8. A gas turbine combustion chamber in accordance with claim 4, wherein, effective areas of the starter film holes are equal and at least certain of the starter film holes have different spacing than other starter film holes around the circumference of the combustion chamber.

9. A gas turbine combustion chamber in accordance with claim 4, wherein the local starter film maxima and local starter film minima are produced by varying a number of the starter film holes positioned respective sectors of the circumference of the combustion chamber, with the starter film holes in certain of the sectors positioned on multiple different pitch circles of the combustion chamber.

10. A gas turbine combustion chamber in accordance with claim 4, wherein, at least certain of the starter film holes have different flow coefficients.

11. A gas turbine combustion chamber in accordance with claim 4, wherein, at least certain of the starter film holes have different inlet contours.

12. A gas turbine combustion chamber in accordance with claim 4, wherein, variation of the intensity of the starter film cooling is generally continuous.

13. A gas turbine combustion chamber in accordance with claim 4, wherein, variation of the intensity of the starter film cooling is in discrete states.

14. A gas turbine combustion chamber in accordance with claim 1, wherein, the respective local starter film maxima are aligned with radial projections of the burner axes.

15. A gas turbine combustion chamber in accordance with claim 1, wherein, the respective local starter film maxima are shifted circumferentially relative to radial projections of the burner axes.

16. A gas turbine combustion chamber, comprising:

a plurality of burners positioned around a circumference of the combustion chamber;

a plurality of starter film holes positioned around the circumference of a head of the combustion chamber upstream of any film cooling holes provided on a wall of the combustion chamber to provide starter film cooling of the combustion chamber, the starter film holes being arranged in at least a first set of groups to provide local starter film maxima with a greatest starter film air flow in certain sectors around a circumference of the combustion chamber where a thermal load is greater and a second set of groups to provide local starter film minima with a least starter film air flow in other sectors around the circumference of the combustion chamber where a thermal load is lesser to decrease a temperature gradient of the combustion chamber wall in a circumferential direction.

17. A gas turbine combustion chamber as in claim 16, wherein the greatest starter film air flows in the first set of groups are produced by a greater total flow area of the starter film holes in those groups as compared respectively to the second set of groups.

18. A gas turbine combustion chamber as in claim 17, wherein the greater total flow area is at least partially produced by starter film boles having respectively larger flow areas.

19. A gas turbine combustion chamber as in claim 18, wherein the greater total flow area is at least partially produced by decreased spacing between starter film boles.

20. A gas turbine combustion chamber as in claim 19, wherein the greater total flow area is at least partially produced by additional starter film holes positioned along at least one additional pitch circle of the combustion chamber.

21. A gas turbine combustion chamber as in claim 20, wherein the greatest starter film air flows are also produced by a greater flow coefficient of at least some of the starter film holes.

22. A gas turbine combustion chamber as in claim 21, wherein the greater flow coefficient is provided by contouring inlets of at least some of the starter film holes.

23. A gas turbine combustion chamber as in claim 17, wherein the greater total flow area is at least partially produced by decreased spacing between starter film holes.

24. A gas turbine combustion chamber as in claim 17, wherein the greater total flow area is at least partially produced by additional starter film holes positioned along at least one additional pitch circle of the combustion chamber.

25. A gas turbine combustion chamber as in claim 17, wherein the greatest starter film air flows are produced by a greater flow coefficient of at least some of the starter film holes.

26. A gas turbine combustion chamber as in claim 25, wherein the greater flow coefficient is provided by contouring inlets of at least some of the starter film holes.

27. A gas turbine combustion chamber as in claim 17, wherein, at least one of the local starter film minima is at least partially produced by a reduced number of starter film holes as compared to a number of starter film holes in the sectors having local starter film maxima.

* * * * *